US005622277A

United States Patent [19]

Van Giezen et al.

[11] Patent Number: 5,622,277

[45] Date of Patent: Apr. 22, 1997

[54] COLLAPSIBLE CONTAINER FOR FLUID PRODUCTS

[75] Inventors: Maurice G. M. Van Giezen, Haarlem; Harald Feijth, Utrecht, both of Netherlands

[73] Assignee: Koninklijke Emballage Industrie Van Leer B.V., Amstelveen, Netherlands

[21] Appl. No.: 666,585

[22] PCT Filed: Jan. 5, 1995

[86] PCT No.: PCT/NL95/00010

§ 371 Date: Jun. 21, 1996

§ 102(e) Date: Jun. 21, 1996

[87] PCT Pub. No.: WO95/18754

PCT Pub. Date: Jul. 13, 1995

[30] Foreign Application Priority Data

Jan. 7, 1994 [NL] Netherlands ..... 9400029

[51] Int. Cl.[6] ..... B65D 88/20

[52] U.S. Cl. ..... 220/6; 220/9.2; 220/401; 220/404

[58] Field of Search ..... 220/1.5, 404, 401, 220/9.2, 6, 9.3

[56] References Cited

U.S. PATENT DOCUMENTS

| | | | |
|---|---|---|---|
| 2,008,176 | 7/1935 | Fritsche | 220/9.2 |
| 2,332,999 | 10/1943 | Garvey | 220/9.3 |
| 4,040,460 | 8/1977 | Thornton | 220/9.2 |
| 5,437,384 | 8/1995 | Farrell | 220/9.2 |

FOREIGN PATENT DOCUMENTS

| | | |
|---|---|---|
| 0573230 | 12/1993 | European Pat. Off. . |
| 2246812 | 3/1974 | Germany . |
| 2442322 | 3/1976 | Germany . |

*Primary Examiner*—Joseph M. Moy
*Attorney, Agent, or Firm*—Young & Thompson

[57] ABSTRACT

A container device for bulk goods or liquid comprises a folding frame and a container accommodated in the frame, which frame comprises a base section as well as at least two folding side sections provided on opposite sides of the base section, which side sections are movable between a horizontal position and an upright position. The frame has a top section which is supported some distance above the base section and foldably interacts with one of he sides.

9 Claims, 6 Drawing Sheets

COLLAPSIBLE CONTAINER FOR FLUID PRODUCTS

The invention relates to a container device for bulk goods or liquid, comprising a frame as well as a container accommodated in the frame. A container device of this type is known. The frame provides the actual container with rigidity as well as protection against external stresses such as arise during storage and transport. Moreover, it contributes to the dimensional stability of the container, including when the latter is completely filled. The container itself is suitable for bulk goods and liquids.

In connection with environmental requirements, packaging must be suitable for re-use. In practice this means that the packaging has to be returned separately, which, especially in the case of bulk packaging, is associated with drawbacks in view of the transport volume required for this. The known container device has the drawback that, despite the fact that the container itself can be made of flexible material, the empty container device, as a consequence of the rigid frame, still has the same volume as the full device.

The aim of the invention is, therefore, to overcome this disadvantage. This is achieved in that the frame can be folded up. In particular, the frame can comprise a base section as well as at least two foldable side sections provided on opposite sides of the base section, which side sections are movable between a horizontal position and an upright position.

Moreover, the frame can have a top section which is supported some distance above the base section and foldably interacts with one of the sides. With this arrangement, the sides and the top section can be folded about hinges, the centre lines of which are parallel to one another.

The container device can be folded up compactly if the hinges of the side connected to the top section are fitted some distance above the base section, in such a way that the top section folded against said side fits between the base section and said side folded on said base section. Furthermore, the hinges of the other side can be fitted a greater distance away from the base section, in such a way that said side can be folded onto the side carrying the top section. Nevertheless, the hinges can also be positioned such that the side with the top section can be folded on top of the other side.

Base section and sides are preferably constructed of tubular material, the base section being a tube which forms a one-piece unit essentially in the form of a rectangle, two opposite sides of which are bent down close to the corners of the rectangle in such a way that the other two opposite sides are outside the plane described by the first two opposite sides. Those sides of the base section which are bent down provide an opening with respect to the floor or surface on which the base section rests. The container device can be lifted at this point by inserting the forks of a fork-lift truck in the opening.

The container device is particularly suitable for stacking in the filled state. To this end, the bottom of the base section and the tops of the sides have support points by means of which the device is stackable. The frame offers the requisite support for various container devices stacked on top of it.

However, stackability is also ensured in the folded state if the sides are hingably mounted in corner pieces which protrude above the sides and top section folded onto the base section.

According to a first possibility, the container is a sack made of flexible material, which preferably is fixed at its top edges to the top section. In order to obtain a shape which as far as possible approaches a block shape with a flexible sack of this type even when the latter is filled, the side walls of the sack are each fixed to the top section in such a way that the middle section of each wall has a lesser height than the sections located close to the corners of the sack.

The consequence of this shape is that the middle section of each side wall of the sack is subjected to higher tensile forces than the sections located closer to the corners of the sack. In this way, a corrective effect is obtained precisely in said middle section, which, after all, has the greatest tendency to bulge, as a result of which corrective effect the block shape can approximately be retained.

In this context, the side walls of the sack are each cut along a concave line at their top edge. If this top edge is now attached to the frame in a straight line, the shortening of the side walls in their middle section is obtained immediately.

A further improvement in this respect can be obtained if the base section is provided with a solid base and the bottom of the sack partially rests on the solid base.

The invention will be explained in more detail below with reference to an illustrative embodiment shown in the figures.

Figure 1:
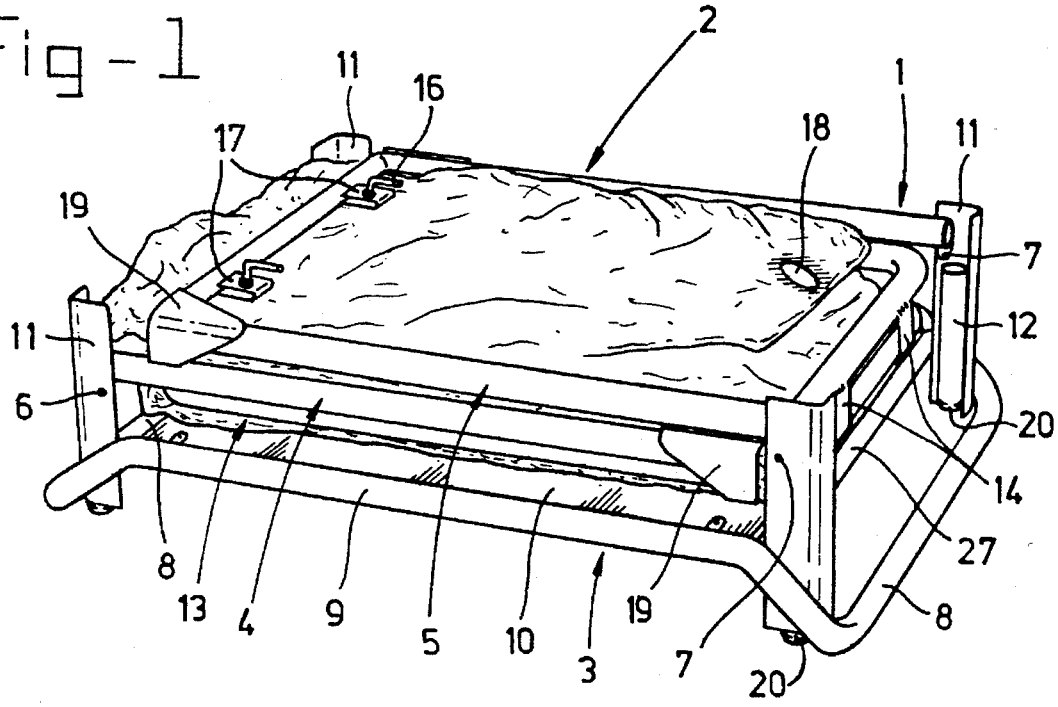
FIG. 1 shows a perspective view of the container device according to the invention in the folded position.

The container device shown in FIG. 1 comprises a frame, which is indicated in its entirety by 1, and a flexible sack, indicated by 2. The frame 1 has a base section 3 to which the two sides 4 and 5 are hingably connected by hinges 6 and 7 respectively.

In the embodiment shown the base section 3 is composed of a tube of circular cross-section which forms a rectangle and the sides 8 of which are bent downwards with respect to the other sides 9. Said sides 9 are therefore some distance away from the floor or surface on which the frame 1 is placed, such that the fork of a fork-lift truck can be introduced beneath the sides 9.

Furthermore, a base 10 is fitted between the sides 9, whilst support points are arranged close to the corners of the base section, which support points comprise L-shaped corner pieces 11 to which tube sections 12 are welded. Said corner pieces 11 also carry the hinges 6 and 7 for the sides 4 and 5 respectively.

Figure 2:
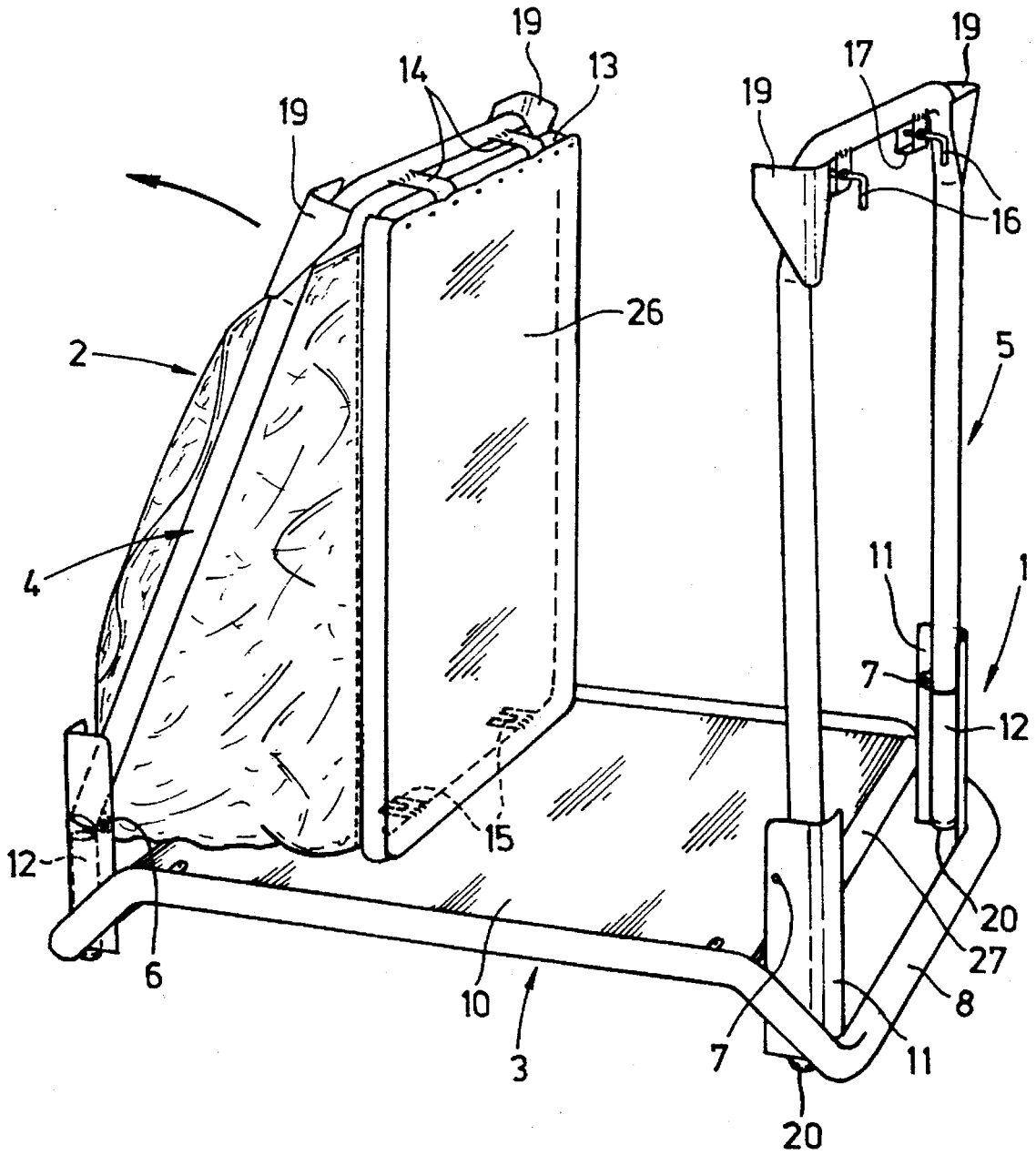
FIG. 2 shows a perspective view of the container device in the partly unfolded position.

As can be seen more clearly in FIG. 2, a top section 13 is hingably attached via spacers 14 to the side 4. The sack 2 is fixed, in a manner which will be described below, to said top section 13, which likewise comprises a one-piece tube, which in the example shown is of circular cross-section. Furthermore, the cover flap 26 for the sack 2 is fitted to the top section 13. A separate piece of material, which does not form part of the sack 2, can also be used for the flap 26.

The top section 13 is provided with flanges 15 on its side opposite the spacers 14, which flanges can be fixed, for example by means of associated clamps 16, which are accommodated in brackets 17, to the side 5 of the container device.

Figure 3:
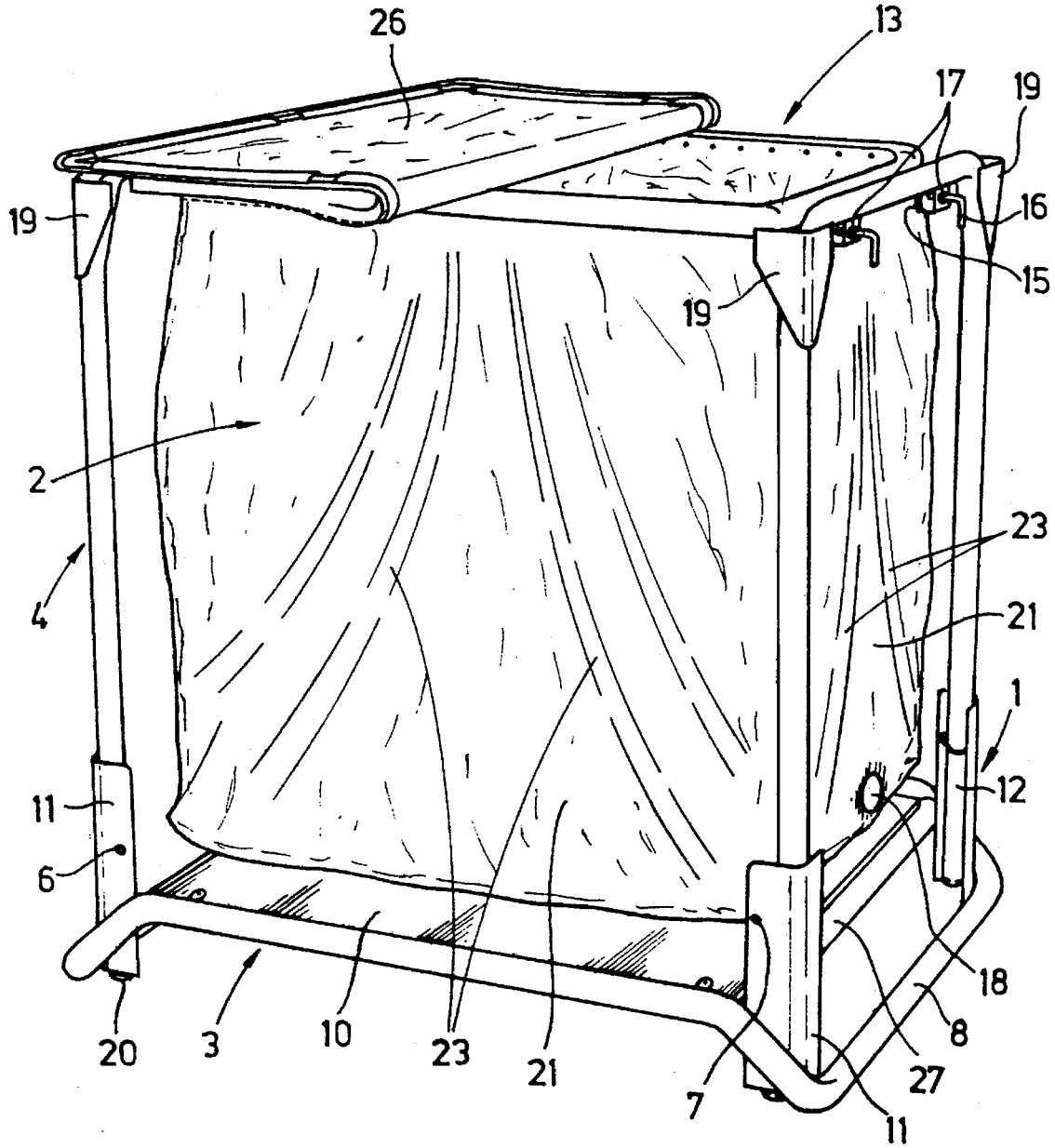
FIG. 3 shows a perspective view of the container device in the completely unfolded position, whilst it is still empty.

In the position shown in FIG. 3, the container device is completely folded open, the top section 13 being fixed to the side 5 by means of the said screw/nut connectors 16. The cover flap 26 is partly folded back. A band is fitted in the periphery of the cover flap 26, in such a way that the cover flap 26 can be fitted over the periphery of the top section 13, as a result of which the flexible sack 2 is closed off. Furthermore, the flexible sack 2 can be provided with an emptying opening 18.

Figure 4:
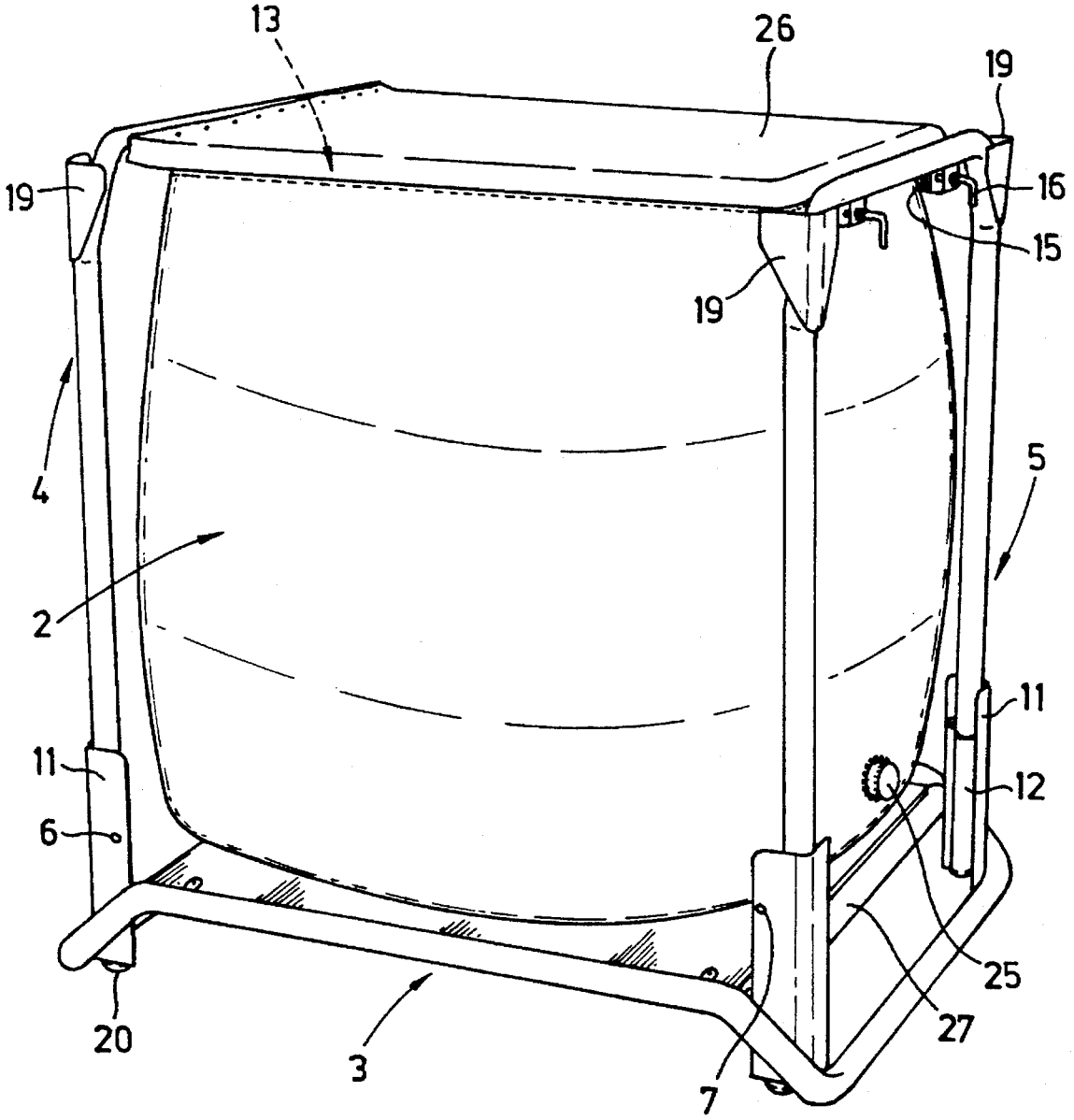
FIG. 4 shows a perspective view of the filled container device.

In the position shown in FIG. 4, the container device according to the invention is completely filled. In this position, the walls of the container bulge slightly outwards, but only to a limited extent because of the connection, which will be described below, of the flexible sack 2 to the top section 13. In the position shown in FIG. 4, the cover flap 26 has been pulled down over the periphery of the top section 13 by means of its band. The emptying opening is also provided with a closure It can also be seen that the sides 4 and 5 are provided at their tops with support pieces 19 of L-shaped cross-section, on which another unfolded container device can be supported via its corner pieces 11, as will be explained in more detail.

Figure 5:
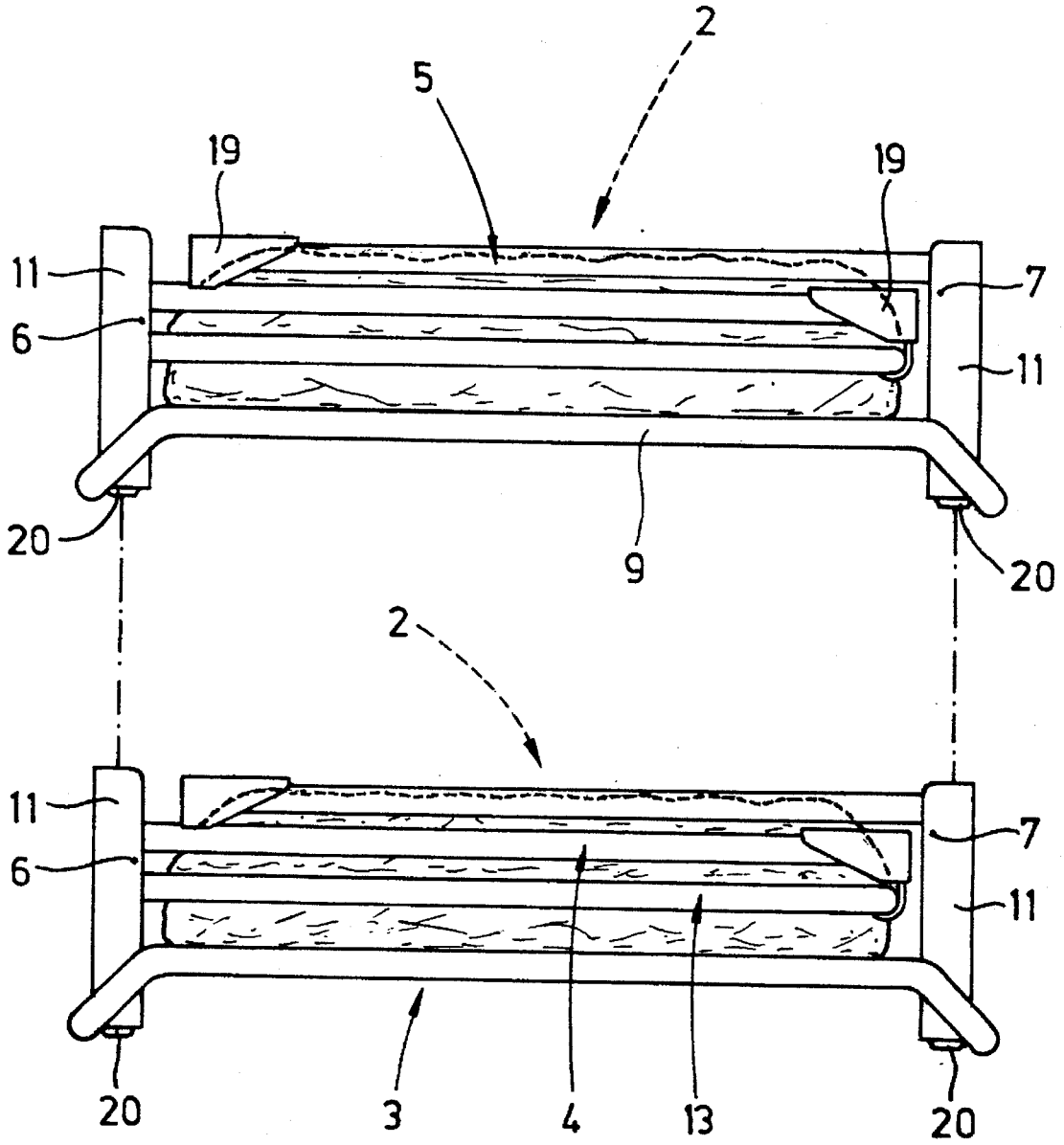
FIG. 5 shows a side view of two folded containers which are stackable on top of one another.

The folded-up container devices shown in FIG. 5 can be stacked directly on top of one another by means of their corner pieces 11. In a stack, the tube sections 12, which protrude a little below the associated comer piece 11 and have a conical end 20 on that underside, fit inside the underlying corner piece 11, as a result of which stable stacking is ensured.

Figure 6:
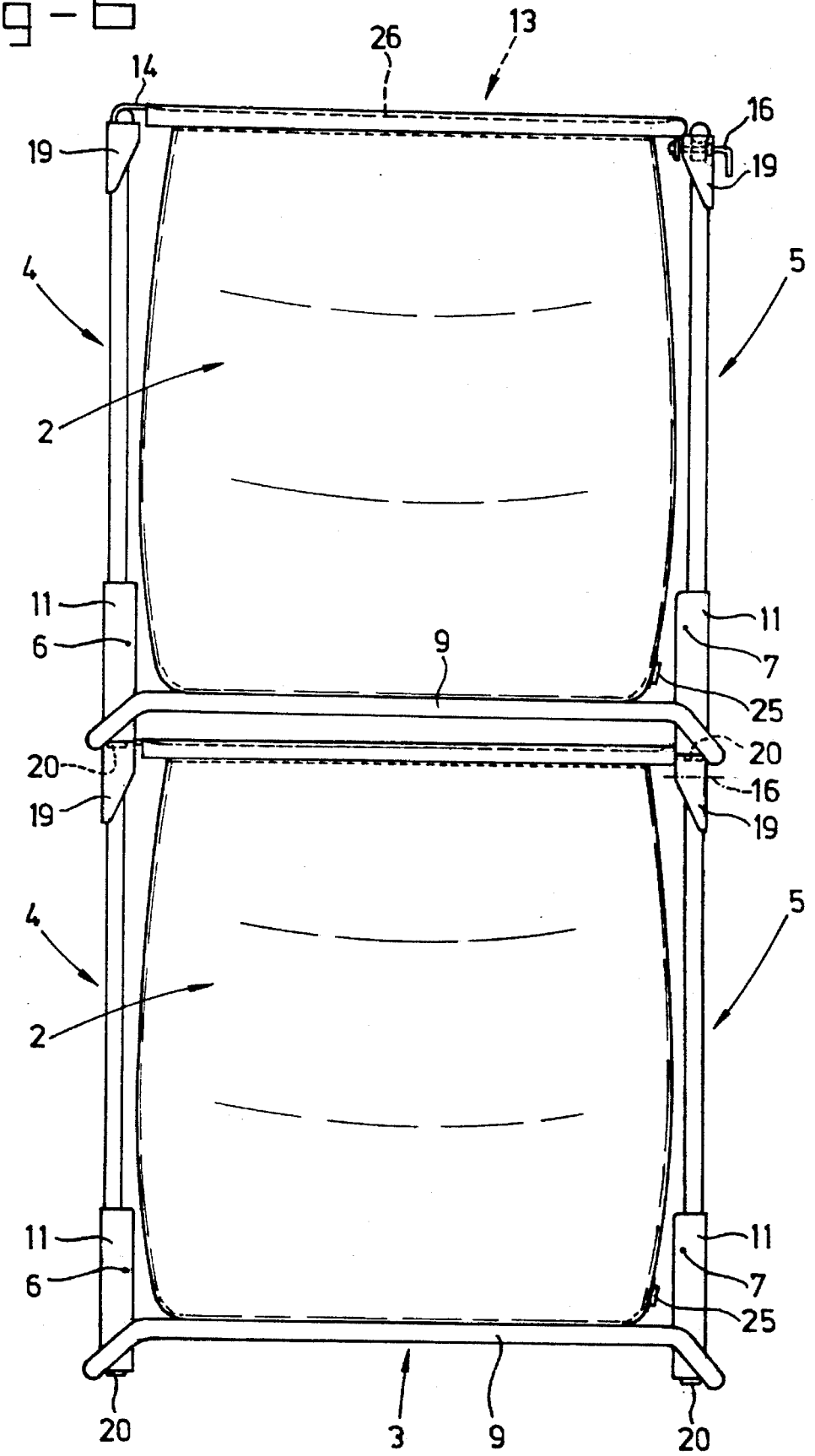
FIG. 6 shows a perspective view of two completely unfolded containers which are stacked on top of one another.

In the position shown in FIG. 6, two unfolded containers are stacked on one another. In this arrangement, the corner pieces 11 of the upper container rest on the support pieces 19 of an underlying container, the conical ends 20 of the upper container device fitting inside the support pieces 19. With this arrangement as well, stable stacking is ensured. Moreover, the conical shape of the ends 20 makes stacking easier.

Figure 7:
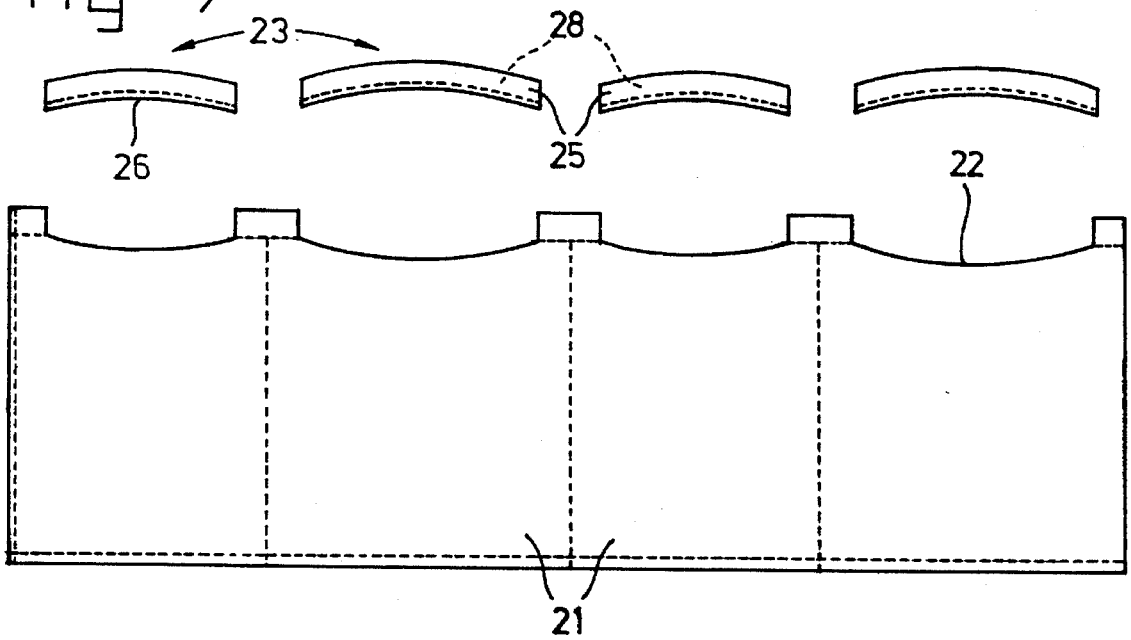
FIG. 7 shows an outline of the walls of the flexible sack.
Figure 8:
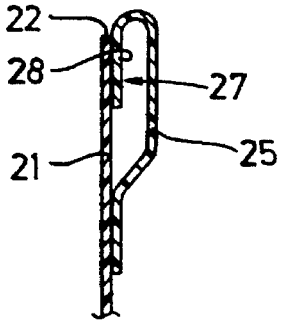
FIG. 8 shows a section through the seam of the sack.

FIG. 7 shows an outline of the side walls of the flexible sack 2. Each of said side walls 21 has a top edge 22 Cut along a concave line. An associated strip of material is also shown at each top edge, which strip of material consists of two folded flaps 28 and 25, as shown in the cross-section in FIG. 8. In this cross-section it can also be seen that flaps 28 and 25 are each welded to the relevant side wall 21. With this arrangement, the middle of said side wall must be pulled upwards, in such a way that the concave lines 22 of the sack, and the strips 26, which are of opposite curvature, are pulled straight.

In this way a seam 27 is formed, in which a flat metal strip is inserted and which is fixed to a tube section of the top section.

Each top edge 22 is pulled a little upwards at the centre, as a result of which the folds 23 are formed, as shown in FIG. 3 As a consequence, the middle section of each side wall 21 is, as it were, pulled a little upwards. The consequence of this is that bulging of the flexible sack when the latter is filled is appreciably less than would be the case if the top edges 22 had been produced along a straight line. It is precisely in the middle of the side walls 21, where the tendency to bulging is greatest when the sack is filled, that the shape of the top edge provides for a relatively high tensile force, which produces a corrective effect against bulging.

We claim:

1. Container device for bulk goods or liquid, comprising a folding frame (1) as well as a flexible container (2) accommodated in the frame (1), which frame (1) comprises a base section (3) as well as at least two foldable side sections (4, 5) provided on opposite sides of the base section (3), which side sections (4, 5) are movable between a horizontal position and an upright position, and a top section (13) which is supported some distance above the base section (3) by the upright side sections (4, 5), the container (2) being fixed to the top section at its top edges (22), characterized in that the side walls (9) of the container (2) are each cut along a concave line at their top edge (22) and are each fixed to the top section (13) in such a way that the middle section of each wall has a lesser height than the sections located close to the corners of the container (2).

2. Device according to claim 1, wherein the side sections (4, 5) and the top section (13) can be folded about hinges (6, 7), the center lines of which are parallel to one another.

3. Device according to claim 2, wherein the hinges (6) of the side section (4) connected to the top section (13) are fitted some distance above the base section (3), in such a way that the top section (13) folded against said side section (4) fits between the base section (3) and said side section (4) folded on said base section (3).

4. Device according to claim 3, wherein the hinges (7) of the other side section (5) are fitted a greater distance away from the base section (3), in such a way that said side section (5) can be folded onto the side section (4) carrying the top section (13).

5. Device according to claim 1, wherein base section (3) and side sections (4, 5) are rectangles which are constructed of tubular material.

6. Device according to claim 5, wherein the base section (3) is a tube which is bent in the form of a rectangle, two opposite sides (8) of which are bent down close to the corners of the rectangle in such a way that the other two opposite sides (9) are outside the plane described by the first two opposite sides (8).

7. Device according to claim 1, wherein the bottom of the base section (3) and the tops of the side sections (4, 5) have support points (19, 20) by means of which the device is stackable.

8. Device according to claim 7, wherein the side sections (4, 5) are hingeably mounted in corner pieces (11) which protrude above the side sections (4, 5) and top section (13) folded onto the base section (3), in such a way that the device is stackable when it is folded up.

9. Device according to claim 1, wherein the base section (3) is provided with a solid base (10) and the bottom of the sack (2) at least partially rests on the solid base (10).

* * * * *